US006892034B2

(12) United States Patent
Katayanagi et al.

(10) Patent No.: US 6,892,034 B2
(45) **Date of Patent: *May 10, 2005**

(54) IMAGE-FORMING APPARATUS FOR OBTAINING CLEAN IMAGES

(75) Inventors: Hidetoshi Katayanagi, Tokyo (JP); Masashi Saito, Tokyo (JP); Shigetaka Kurosu, Tokyo (JP)

(73) Assignee: Konica Corporation, Tokyo (JP)

( * ) Notice: Subject to any disclaimer, the term of this patent is extended or adjusted under 35 U.S.C. 154(b) by 23 days.

This patent is subject to a terminal disclaimer.

(21) Appl. No.: 10/621,624

(22) Filed: Jul. 16, 2003

(65) Prior Publication Data

US 2004/0018026 A1 Jan. 29, 2004

Related U.S. Application Data

(63) Continuation of application No. 09/969,951, filed on Oct. 3, 2001, now Pat. No. 6,603,932.

(30) Foreign Application Priority Data

Oct. 6, 2000 (JP) ..... 2000-307486

(51) Int. Cl.[7] ..... G03G 15/00
(52) U.S. Cl. ..... 399/21; 399/49; 399/101
(58) Field of Search ..... 399/18–21, 49, 399/66, 71, 72, 101, 299, 302, 308

(56) References Cited

U.S. PATENT DOCUMENTS

| | | | | |
|---|---|---|---|---|
| 5,117,261 A | | 5/1992 | Sakai et al. | |
| 5,559,590 A | | 9/1996 | Arai et al. | |
| 5,970,278 A | | 10/1999 | Munakata | |
| 6,321,059 B1 | | 11/2001 | Tamura | |
| 6,327,451 B1 | * | 12/2001 | Mizuno | 399/281 |
| 6,347,196 B1 | | 2/2002 | Kawabata et al. | |
| 6,477,340 B2 | | 11/2002 | Tomizawa et al. | |
| 6,603,932 B2 | * | 8/2003 | Katayanagi et al. | 399/21 |

FOREIGN PATENT DOCUMENTS

| | | |
|---|---|---|
| JP | 11-21246 A | 8/1999 |
| JP | 2000-330444 A | 11/2000 |

* cited by examiner

*Primary Examiner*—Robert Beatty
(74) *Attorney, Agent, or Firm*—Frishauf, Holtz, Goodman & Chick, P.C.

(57) ABSTRACT

An image-forming apparatus is provided which primarily transfers a toner image onto an intermediate transfer member, and then secondarily transfers the toner image from the intermediate transfer member onto a transfer material, wherein a controller controls the process so that when the image forming apparatus stops, a toner image pattern α formed on a non-image area of a photoconductive member is prevented from causing image problems.

21 Claims, 2 Drawing Sheets

IMAGE-FORMING APPARATUS FOR OBTAINING CLEAN IMAGES

CROSS-REFERENCE TO RELATED APPLICATIONS

This application is a continuation of application Ser. No. 09/969,951 filed Oct. 3, 2001 now U.S. Pat. No. 6,603,932.

BACKGROUND OF THE INVENTION

The present invention relates to an image-forming apparatus which is controlled to stop to avoid a situation where the adherence between toner of the image pattern α in the non-image area and a photoreceptor, intermediate transfer member or a second transfer roller increases, so as to keep the inside of the apparatus clean and to obtain clean images. Here, the image pattern α is an image which inevitably forms when an image forming operation has stopped or an image pattern created in the non-image area which comes after the image area before the image forming operation is stopped and used for optimizing the quality of the normal image by detecting the density, position, etc. of the image.

There is a well-known image-forming apparatus which forms a toner image on a photoreceptor having charging, exposing, and reversal developing means in its periphery, transfers (i.e. first transfer) the toner image onto an intermediate transfer member, and then transfers (i.e. second transfer) the toner image from the intermediate transfer member onto transfer material, such as transfer paper or the like used as recording material. This kind of apparatus uses a two-component developer which includes toner having the same charging polarity as that of the photoreceptor so as to perform reversible deposition. In order to prevent a two-component developer carrier from adhering to the photoreceptor, the developing bias is impressed before charging is started when an image forming operation starts and then the developing bias is turned off after charging has been finished when the image forming operation stops. This causes the toner to adhere to the area located before and after the charged area on the photoreceptor in a belt-like appearance. If the adhering toner (especially, the toner that has adhered when the image forming operation stopped) remains on the photoreceptor or the intermediate transfer member, the toner adherence increases causing an insufficient cleaning, which results in poor image quality when the next image is printed. Further, if the adhering toner remains sandwiched between two members or remains receiving heat from the fixing unit, etc., the adherence between the toner and a transfer member, such as an intermediate transfer member, photoreceptor, or a transfer roller, further increases causing an insufficient cleaning, which results in poor image quality. Furthermore, if the toner in the image area remains on a photoreceptor or an intermediate transfer member when transfer material, such as transfer paper or the like, jams, the same thing can happen. Especially, if the adhering toner remains sandwiched between two members or remains receiving heat from the fixing unit, etc., the adherence between the toner and a transfer member, such as an intermediate transfer member, photoreceptor, or a transfer roller, further increases causing an insufficient cleaning, which results in poor image quality. Those cases happen frequently.

OBJECT OF THE INVENTION

One purpose of the present invention is to provide an image-forming apparatus for forming a toner image on a photoreceptor, primarily transferring the toner image on the photoreceptor onto an intermediate transfer member and secondarily transferring the toner image from the intermediate transfer member onto transfer material, such as transfer paper or the like used as recording material, which does not have the problem described above. That is to say, one purpose of the present invention is to provide an image-forming apparatus which does not stop, when a toner image exists in the non-image area and the toner image remains sandwiched between a photoreceptor and an intermediate transfer member or the intermediate transfer member and a second transfer member, so as to prevent the adherence between each member and the toner from increasing, thereby preventing image problems which affect the creation of the next image from occurring.

SUMMARY OF MEANS FOR ACHIEVING THE INVENTION (1.) According to one aspect of the invention, an image-forming apparatus is provided for forming a toner image on a photoreceptor having charging, exposing and developing means in its periphery, primarily transferring the toner image onto an intermediate transfer member, and then secondarily transferring the toner image from the intermediate transfer member onto a transfer material. The apparatus includes a cleaning device for removing residual toner which has adhered to the downstream-side surface of the intermediate transfer member in its rotational direction after the second transfer position, and a controller for controlling a first transfer voltage or current so that most of the toner image pattern α which has been formed in the non-image area on the photoreceptor is transferred onto the intermediate transfer member and stored thereon and also stopping the intermediate transfer member after the toner which adhered to the intermediate transfer member has been removed.

(2.) According to another aspect of the invention, the image-forming apparatus includes a cleaning device for removing residual toner which has adhered to the downstream-side surface of the photoreceptor in its rotational direction before the first transfer position, and a controller for controlling a first transfer voltage or current so that most of the toner image pattern α which has been formed in the non-image area on the photoreceptor remains on the photoreceptor and also stopping the photoreceptor after the toner which has adhered to the photoreceptor has been removed.

(3.) According to another aspect of the invention, the image-forming apparatus includes a second transfer member, and a controller for stopping the photoreceptor and the intermediate transfer member at a position where the toner image pattern α which has been formed in the non-image area on the photoreceptor when the apparatus was stopped is not sandwiched between the contacting parts of the photoreceptor and the intermediate transfer member.

(4.) According to another aspect of the invention, the image-forming apparatus is provided with a roller or belt for making the second transfer member come in contact with the intermediate transfer member, and a controller for stopping the intermediate transfer member at a position where the toner image pattern α which has been formed in the non-image area on the photoreceptor when the apparatus was stopped is not sandwiched between the contacting parts of the second transfer member and the intermediate transfer member.

(5.) According to another aspect of the invention, the image-forming apparatus is provided with a roller or belt for making the second transfer member come in contact with the intermediate transfer member, and a controller for stopping the intermediate transfer member after the toner image pattern α which has been formed in the non-image area when the apparatus was stopped has passed the contacting parts of the photoreceptor and the intermediate transfer member and is located at a position before the contacting parts of the second transfer member and the intermediate transfer member.

(6.) According to another aspect of the invention, the image-forming apparatus includes a controller for controlling a first transfer voltage or current so that most of the toner image pattern α which has been formed in the non-image area on the photoreceptor before the apparatus is stopped is transferred onto the intermediate transfer member and stored thereon and also stopping the intermediate transfer member so that the toner image does not remain at a position close to a fixing unit.

(7.) According to another aspect of the invention, the image-forming apparatus includes a cleaning device for removing residual toner which has adhered to the downstream-side surface of the intermediate transfer member in its rotational direction before the second transfer position, and a controller for releasing the press-contact of the intermediate transfer member with a secondary contact transfer member when a paper jam has occurred, controlling a first transfer voltage or current so that most of the residual toner image is transferred onto the intermediate transfer member and stored thereon, and also stopping the intermediate transfer member after the toner which has adhered to the intermediate transfer member has been removed.

(8.) According to another aspect of the invention, the image-forming apparatus includes a controller for releasing the press-contact of the intermediate transfer member with a secondary contact transfer member when a paper jam has occurred, and then stopping the intermediate transfer member and the photoreceptor at a position where the residual toner image is not sandwiched between the contacting parts of the photoreceptor and the intermediate transfer member.

(9.) According to another aspect of the invention, the image-forming apparatus includes a controller for releasing the press-contact of the intermediate transfer member with a secondary contact transfer member when a paper jam has occurred, and then stopping the intermediate transfer member so that the residual toner image on the intermediate transfer member does not remain at a position close to a fixing unit.

As described in Means (1) or (7), it is possible to prevent image problems by controlling an image-forming apparatus to transfer most of the untransferred toner image which has been formed in the non-image area or at a time of a jam onto an intermediate transfer member and store it thereon, and then remove the residual toner on said intermediate transfer member by a cleaning device, such as a blade, etc., and finely stop the apparatus.

In Means (8), when a jam has occurred, an image-forming apparatus is controlled to stop in a state where the toner image on an intermediate transfer member is not located on the first transfer contacting parts (i.e. the contacting parts of a photoreceptor and said intermediate transfer member) and also the press-contact of the second transfer roller has been released. Consequently, it is possible to prevent the toner adherence from increasing.

Further, as described in Means (2), it is possible to prevent image problems by keeping most of the untransferred toner image which has been formed in the non-image area or at a time of jam on a photoreceptor without transferring the image onto an intermediate transfer member and then removing the residual toner on said photoreceptor by a cleaning device, such as a blade, etc., and finally stopping the apparatus. Normally, the distance between the first transfer position and the cleaning position of the photoreceptor is shorter than the distance between the first transfer position and the cleaning position of the intermediate transfer member. Therefore, according to Means (1), the time duration for running the image-forming apparatus is shorter, which improves the durability of various components.

As described in Means (3), it is possible to prevent image problems by stopping a photoreceptor at a position where the adhering toner in the non-image area does not remain sandwiched between the contacting parts (i.e. first transfer nipping part) of an intermediate transfer member and said photoreceptor. In this case, when there is a sufficient distance between a developing part and a first transfer nipping part, stopping said photoreceptor at this position requires less time to rotate said photoreceptor, etc., which improves the durability. However, it is difficult to create a sufficient clearance between the developing part and the first transfer nipping part when the photoreceptor-peripheral area is made compact. But, it is possible to reduce the time required for said photoreceptor to rotate while making the photoreceptor-peripheral area compact by stopping an intermediate transfer member at a position which is located before, preferably right before, (i.e. on the downstream side) the first transfer nipping part (i.e. first transfer position) where the adhering toner remains. Further, when a second transfer nipping part is made by a contact transfer member, such as a transfer roller or a transfer belt, as described in Means (4), it is possible to prevent image problems by stopping the intermediate transfer member at a position where the adhering toner in the non-image area does not remain sandwiched between the contacting parts (i.e. second transfer nipping part) of said intermediate transfer member and a second transfer member. Furthermore, as described in Means (5), in addition to the structure of Means (4), by controlling the stop position of said intermediate transfer member so that it stops before the toner image on said intermediate transfer member comes to the second transfer position, it is possible to reduce the time required for rotating the photoreceptor, etc., which improves the durability.

Furthermore, when said intermediate transfer member is stopped with the adhering toner stored thereon, as described in Means (6) or (9), it is possible to prevent image problems by controlling the stop position of said intermediate transfer member so that it is not exposed to the heat mainly caused by a fixing unit, for example, high temperatures exceeding the toner's glass transition point which appear between 50° C. and 60° C. centigrade.

DETAILED DESCRIPTION OF THE PREFERRED EMBODIMENT

Preferred embodiments of the present invention will be described in detail below referring to drawings.

Descriptions below are not to be construed to limit the scope of the invention or the definition of terms.

Figure 1:
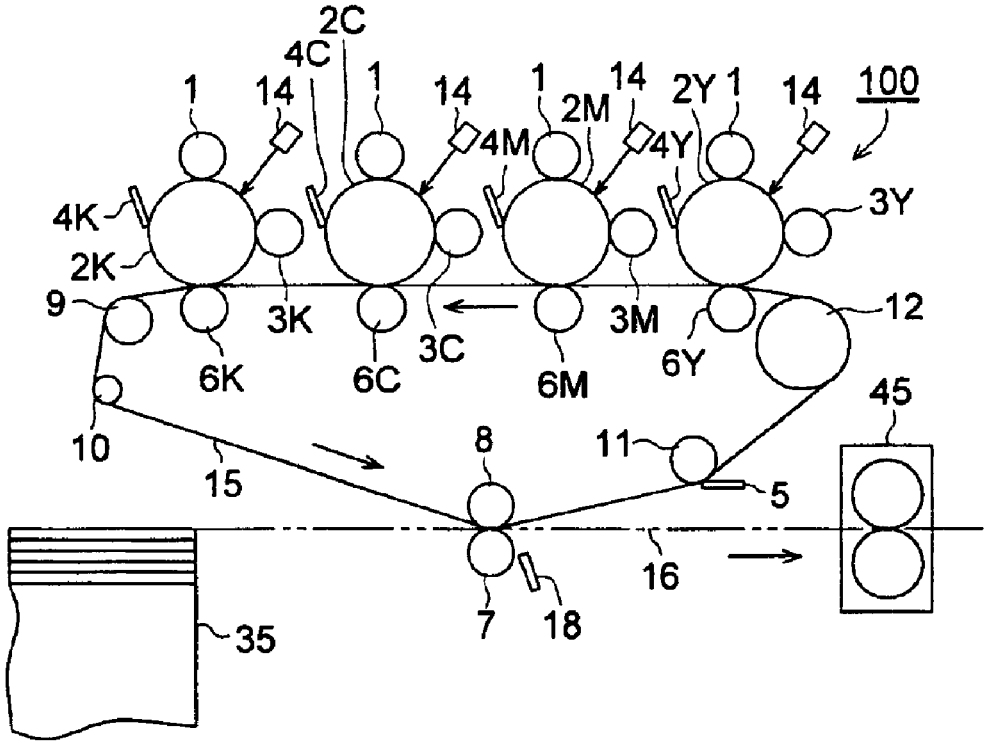
FIG. 1 is a schematic diagram that illustrates an image-forming apparatus which is an embodiment of the present invention.

FIG. 1 is a schematic diagram of a color image-forming apparatus which relates to the present invention, and especially of an image-forming apparatus wherein an intermediate transfer belt is placed horizontally in a longitudinal direction so that monochrome and full-color images can be formed.

This embodiment comprises plural sets (i.e. four sets in this embodiment) of image forming unit 100, for each color, each at least comprising a photoreceptor 2 used as an image forming body or an image carrier, an charging roller 1 used as charging means, an exposing optical system 14 used as image writing means, and a developing device 3 used as developing means. In the embodiment, each image forming unit 100 of yellow (Y), magenta (M), cyan (C) and black (K) is placed beginning from the right in the following order: Y, M, C, K, oppositely facing the horizontal stretching surface of an intermediate transfer belt 15 which travels in a loop. The four sets of image forming units 100 for four colors have the same structure.

The charging roller 1 electrifies the photoreceptor 2 with an electric charge which has the same polarity as the toner (i.e. negative charging in this embodiment) at each given potential in order to apply a uniform electric potential to the photoreceptor 2.

The exposing optical system 14 is placed on the downstream side of the charging roller 1 in the rotational direction of the photoreceptor 2 and is also located on the upstream side of the developing device 3. The exposing optical system 14 is an exposing unit consisting of exposing elements arrayed in the main scanning direction in parallel to the rotating shaft of the photoreceptor 2, for example, an array of plural LEDs (Light Emitting Diodes), and a light convergent light transmitting body (product name: Selfoc Lens Array) used as an image-forming element. A laser optical system can be applied to the exposing optical system 14. The exposing optical system 14 exposes an image on the photoreceptive layer of the photoreceptor 2 according to each color's image data which has been read by an image reading device installed separately and recorded in the memory, and then forms an electrostatic latent image of each color.

In the photoreceptor 2 (2Y, 2M, 2C, 2K), photoreceptive layers of the charge generating layer (lower layer) and the charge transporting layer (upper layer) are laminated in the described order or reverse order on the under-coating layer formed on the surface of a conductive cylindrical supporting body. A publicly known surface protecting layer, for example, an over-coating layer mainly made of thermoplastic or thermosetting polymer, may be formed on the surface of the charge transporting layer or the charge generating layer. In this embodiment, the conductive cylindrical supporting body of the photoreceptor 2 is grounded.

The developing device 3 (3Y, 3M, 3C, 3K) has a cylindrical non-magnetic stainless steel or aluminum developing sleeve (not shown) which maintains given clearance between the peripheral surface of the photoreceptor 2 and rotates in the same direction as that of the photoreceptor 2. The developing sleeve contains a one- or two-component developer which includes yellow (Y), magenta (M), cyan(C) and black (K) according to each developing color (i.e. toner is negatively charged in this embodiment). In this embodiment, a two-component developer is contained. The sleeve of the developing device 3 does not come in contact with the drum surface of the photoreceptor 2 maintaining given clearance, for example, 100 to 500=|m by means of a thrust roller (not shown) or the like. A toner image is formed on the drum of the photoreceptor 2 by impressing the developing bias which superimposes the direct current voltage and the alternating current voltage on the developing sleeve thereby performing the contact or non-contact reversible deposition.

An intermediate transfer member (i.e. intermediate transfer belt) 15 is tightly stretched being circumscribed by an intermediate transfer belt drive roller 11, intermediate transfer belt tension roller 12, intermediate transfer belt supporting rollers 9 and 10 and a second transfer backup roller so that the intermediate transfer member (i.e. intermediate transfer belt) 15 rotates in the counter-clockwise direction. Further, a second transfer roller 7 oppositely faces a second transfer backup roller 8 via the intermediate transfer member (i.e. intermediate transfer belt) 15. Further, a cleaning blade 5 abuts on the intermediate transfer member (intermediate transfer belt) 15 located at the position of the drive roller 11, a cleaning blade B 18 abuts on the second transfer roller 7, and each cleaning blade (4Y, 4M, 4C, 4K) abuts on each photoreceptor 2, which carries images, in the counter-clockwise direction respectively. Furthermore, similarly, each first transfer roller 6 (6Y, 6M, 6C, 6K) for each color oppositely faces each photoreceptor 2 via the intermediate transfer member (i.e. intermediate transfer belt) 15.

This intermediate transfer member (i.e. intermediate transfer belt) 15 is an endless belt with a volume resistance of $10^6$ to $10^{12}$ Ω·cm. For example, the intermediate transfer belt uses resin material, such as polycarbonate (PC), polyimide (PI), polyamide imide (PAI), polyvinylidene fluoride (PVDF), tetrafluoroethylene-ethylene copolymer (ETFE), etc., or rubber material, such as EPDM, NBR, CR, polyurethane, etc., which mixes conductive filler, such as carbon, etc., or contains ionic conducting material. The preferable thickness is approximately 50 to 2001 m for resin material and about 300 to 700=|m for rubber material. There is a case where a rubber layer is formed on a resin belt, or a coating layer is further formed on the surface layer.

The intermediate transfer member (i.e. intermediate transfer belt) 15 is driven by the rotation of a drive roller 11 which is driven by a drive motor (not shown).

For example, the drive roller 11 is usually made of the material which coats the peripheral surface of a conductive cored bar (no reference numeral assigned), such as stainless steel, etc., with conductive or semi-conductive material (no reference numeral assigned) which mixes rubber or resin material, such as polyurethane, EPDM, silicon, etc. with conductive filler, such as carbon, etc.

The first transfer roller 6 oppositely faces the photoreceptor 2 via the intermediate transfer member (i.e. intermediate transfer belt) 15 thereby forming a transfer area between the intermediate transfer member (i.e. intermediate transfer belt) 15 and the photoreceptor 2. A direct current voltage which has an opposite polarity of the toner (i.e. positive polarity in this embodiment) is applied to the first transfer roller 6 to form an electric field in the transfer area. This makes it possible to transfer toner images of each color which have been formed on the photoreceptor 2 onto the intermediate transfer member (intermediate transfer belt) 15.

The first transfer roller 6 for each color, which is first transfer means, is made, for example, by coating the peripheral surface of a conductive cored bar, such as stainless steel, etc., having an outer-diameter of 8 mm (not shown) with semi-conductive elastic rubber (not shown). The semi-conductive elastic rubber, which mixes rubber material, such as polyurethane, EPDM, silicon etc. with conductive filler, such as carbon, etc. or contains ionic conducting material, is solid or foamed sponge having a volume resistance of approximately $10^5$ to $10^9$ Ω·cm, a thickness of 5 mm, and a rubber hardness (Asker-C) of approximately 20 to 70°.

The second transfer roller 7 for transferring images onto the surface of transfer material oppositely faces the second transfer backup roller 8 which comes in contact with the second transfer roller 7 via the intermediate transfer member (i.e. intermediate transfer belt) 15. A direct current voltage which has an opposite polarity of the toner (i.e. positive polarity in this embodiment) is applied to the second transfer roller 7 by a direct current power source (not shown) in order to transfer the superimposed toner image carried on the intermediate transfer member (intermediate transfer belt) 15 onto the surface of the transfer material.

The second transfer roller 7, which is second transfer means for retransferring color toner images on the intermediate transfer member (intermediate transfer belt) 15 onto recording material, is made, for example, by coating the peripheral surface of a conductive cored bar, such as stainless steel, etc., having an outer-diameter of 16 mm (not shown) with semi-conductive elastic rubber (not shown). The semi-conductive elastic rubber, which mixes rubber material, such as polyurethane, EPDM, silicon etc. with conductive filler, such as carbon, etc. or contains ionic conducting material, is solid or foamed sponge having a volume resistance of approximately $10^5$ to $10^9$Ω·cm, a thickness of 7 mm, and a rubber hardness (Asker-C) of approximately 20 to 70°. Different from the first transfer roller 6, there is a case where the surface of the second transfer roller 7 is coated with semi-conductive fluorocarbon resin or urethane resin, etc. which has a good mold-releasing property because the second transfer roller comes in direct contact with the toner. The second transfer backup roller 8 is made by coating the peripheral surface of a conductive cored bar (not shown), such as stainless steel, etc., with semi-conductive material which mixes rubber or resin material, such as polyurethane, EPDM, silicon etc., with conductive filler, such as carbon, etc., or contains ionic conducting material, forming the coated layer to be approximately 0.05 to 0.5 mm.

The cleaning blade 4 or 5 is made by bonding a urethane rubber sheet that has a thickness of 1 to 3 mm and a JIS-A hardness of 60 to 80onto the sheet metal holder so that the free length becomes approximately 5 to 12 mm. The load of the cleaning blade is approximately 49 to 490 mN and the blade abuts on the photoreceptor 2 and the intermediate transfer belt 15. In some cases, the blade tip is coated with fluorine to prevent the blade from turning up or a conductive urethane rubber is used for the blade to prevent the opposing side from being charged.

Transfer material, such as recording paper, etc., is sent out one by one from a schematically shown integrating. device 35, carried overlapping by the intermediate transfer belt 15 which is sandwiched between the second transfer roller 7 and the second transfer backup roller 8, receives second transfer of the toner image, and sent to a fixing unit 45, then fixed by thermal bonding and finally collected.

In Embodiment (1), the negatively charged yellow toner of the belt-like image pattern a which has been intentionally (or unintentionally) formed in the non-image area coming after the image forming area on the photoreceptor 2Y is transferred onto the intermediate transfer belt by the first transfer roller 6Y wherein a positive transfer voltage has been applied so that the toner can be transferred onto the intermediate transfer belt and stored thereon. After that, a positive transfer voltage is applied to the first transfer roller 6M, 6C, or 6K so that the toner on the intermediate transfer belt will not be retransferred onto each photoreceptor 2M, 2C or 2K. The same operations are conducted as to a negatively charged magenta (cyan, black) belt-like toner which has been intentionally (or unintentionally) formed in the non-image area coming after the image forming area on the photoreceptor 2M (2C, 2K). Then, controller performs the control to remove all of the four color toner image pattern a on the intermediate transfer belt by means of a cleaning blade 5 and then stop the intermediate transfer member (i.e. intermediate transfer belt) 15.

Further, in Embodiment (1), when a jam has occurred, the press-contact of the second transfer roller is released, the toner which remains on the photoreceptor is transferred onto the intermediate transfer member (intermediate transfer belt) 15 and stored thereon by means of the first transfer roller 6Y, 6M, 6C, or 6K wherein a positive transfer voltage is applied so that the toner can be transferred to the intermediate transfer member (i.e. intermediate transfer belt) 15 and stored thereon. After that, controller performs the control to remove all the toner remaining on the intermediate transfer member (i.e. intermediate transfer belt) 15 by means of a cleaning blade 5 and then stop the intermediate transfer belt.

In Embodiment (2), the negatively charged yellow toner of the belt-like image pattern a which has been intentionally (or unintentionally) formed in the non-image area coming after the image forming area on the photoreceptor 2Y is stored on the photoreceptor by the first transfer roller 6Y wherein a negative transfer voltage has been applied so that the toner will not be transferred to the intermediate transfer belt. As to a negatively charged magenta (cyan, black) toner of the belt-like image pattern a which has been intentionally (or unintentionally) formed in the non-image area coming after the image forming area on the photoreceptor 2M (2C, 2K), a negative transfer voltage is applied to the first transfer roller 6M, 6C or 6K so that the same operations are conducted. After that, controller performs the control to remove all of the four color belt-like toner on each photoreceptor 2Y, 2M, 2C or 2K by means of cleaning blades 4Y, 4M, 4C and 4K and then stop the photoreceptor and the intermediate transfer belt. This system requires less time to stop the devices than the system of Embodiment (1).

For example, this system is more preferable when an image density detecting sensor is placed, oppositely facing a photoreceptor, at a position which is on the downstream side of a developing device and also on the upstream side of the first transfer position in the rotational direction of the photoreceptor so that the image density can be detected by using the image pattern a which has been intentionally formed in the non-image area coming after the image forming area. On the other hand, the system of Embodiment (1) is more preferable when an image density detecting sensor is placed, oppositely facing the intermediate transfer member, at a position which is on the downstream side of the first transfer position and also on the upstream side of the cleaning position of the intermediate transfer member in the rotational direction of the intermediate transfer member.

In Embodiment (3), the negatively charged yellow toner of the belt-like image pattern a which has been intentionally (or unintentionally) formed in the non-image area coming after the image forming area on the photoreceptor 2Y is transferred onto the intermediate transfer member (i.e. intermediate transfer belt) 15 by the first transfer roller 6Y wherein a positive transfer voltage has been applied so that the toner can be transferred onto the intermediate transfer belt (i.e. intermediate transfer belt) 15 and stored thereon_ After that, a positive transfer voltage is applied to the first transfer roller 6M, 6C or 6k so that the toner on the intermediate transfer belt (i.e. intermediate transfer belt) will not be retransferred onto each photoreceptor 2M, 2C or 2K. The same operations are conducted as to a negatively charged magenta (cyan, black) toner of the belt-like image pattern a which has been intentionally (or unintentionally) formed in the non-image area coming after the image forming area on the photoreceptor 2M (2C, 2K). After that, controller controls the stop position of the intermediate transfer member (i.e. intermediate transfer belt) 15 so that all of the four color belt-like toner does not stop at a nipping position (i.e. first transfer position) of the first transfer part. Embodiment (4) performs the control to stop the intermediate transfer member (i.e. intermediate transfer belt) 15 at a position where the toner on the intermediate transfer member (i.e. intermediate transfer belt) 15 is not sandwiched at the second transfer position. Further, Embodiment (5) uses the position where the toner on the intermediate transfer member (i.e. intermediate transfer belt) 15 is not sandwiched at the second transfer position, described in Embodiment (4), as the upstream position of the second transfer position.

In Embodiment (6), the negatively charged yellow toner of the belt-like image pattern a which has been intentionally (or unintentionally) formed in the non-image area coming after the image forming area on the photoreceptor 2Y is transferred onto the intermediate transfer member (i.e. intermediate transfer belt) 15 by the first transfer roller 6Y wherein a positive transfer voltage has been applied so that the toner can be transferred onto the intermediate transfer belt (i.e. intermediate transfer belt) 15 and stored thereon. After that, a positive transfer voltage is applied to the first transfer roller 6M, 6C or 6k so that the toner on the intermediate transfer belt will not be retransferred onto each photoreceptor 2M, 2C or 2K. The same operations are conducted as to a negatively charged magenta (cyan, black) toner of the belt-like image pattern a which has been formed in the non-image area coming after the image forming area on the photoreceptor 2M (2C, 2K). After that, controller performs the control to stop the intermediate transfer member (i.e. intermediate transfer belt) 15 while all of the four color belt-like toner on the intermediate transfer member (i.e. intermediate transfer belt) 15 is located on the upstream side of the second transfer position where the toner is not affected by heat caused by a fixing unit 45. This system requires less time to stop the device than the system of Embodiment (1).

In Embodiment (7), when a jam has occurred, controller controls a voltage and current to be applied to the first transfer roller 6 so that all of the toner on the photoreceptor is transferred onto the intermediate transfer member (i.e. intermediate transfer belt) 15 at the first transfer nipping part, then removes the toner remaining on the intermediate transfer member (intermediate transfer belt) 15 by means of a cleaning blade 5 while releasing the press-contact of the second transfer roller 7 at a second transfer nipping part, and finally stops the intermediate transfer member (i.e. intermediate transfer belt) 15.

In Embodiment (8), when a jam has occurred, controller controls a voltage and current to be applied to the first transfer roller 6 so that all of the toner on the photoreceptor is transferred onto the intermediate transfer member (i.e. intermediate transfer belt) 15 at the first transfer nipping part, and then stops the intermediate transfer member (i.e. intermediate transfer belt) 15 and the photoreceptor 2 while releasing the press-contact of the second transfer roller 7 at a second transfer part.

In Embodiment (9), when a jam has occurred, controller controls a voltage and current to be applied to the first transfer roller 6 so that all of the toner on the photoreceptor is transferred onto the intermediate transfer member (i.e. intermediate transfer belt) 15 at the first transfer nipping part, and then controls the residual toner not to remain at a position close to the fixing unit 45 while releasing the press-contact of the second transfer roller 7 at a second transfer nipping part.

As described above, an explanation has been given mainly focusing on a belt-like image pattern for detecting image density, which has been described as the image pattern a in the non-image area. Besides this, a image pattern which has been unintentionally formed according to the conditions of the image forming process, or a position detecting pattern for accurately superposing images of each color can be applied.

Figure 2:
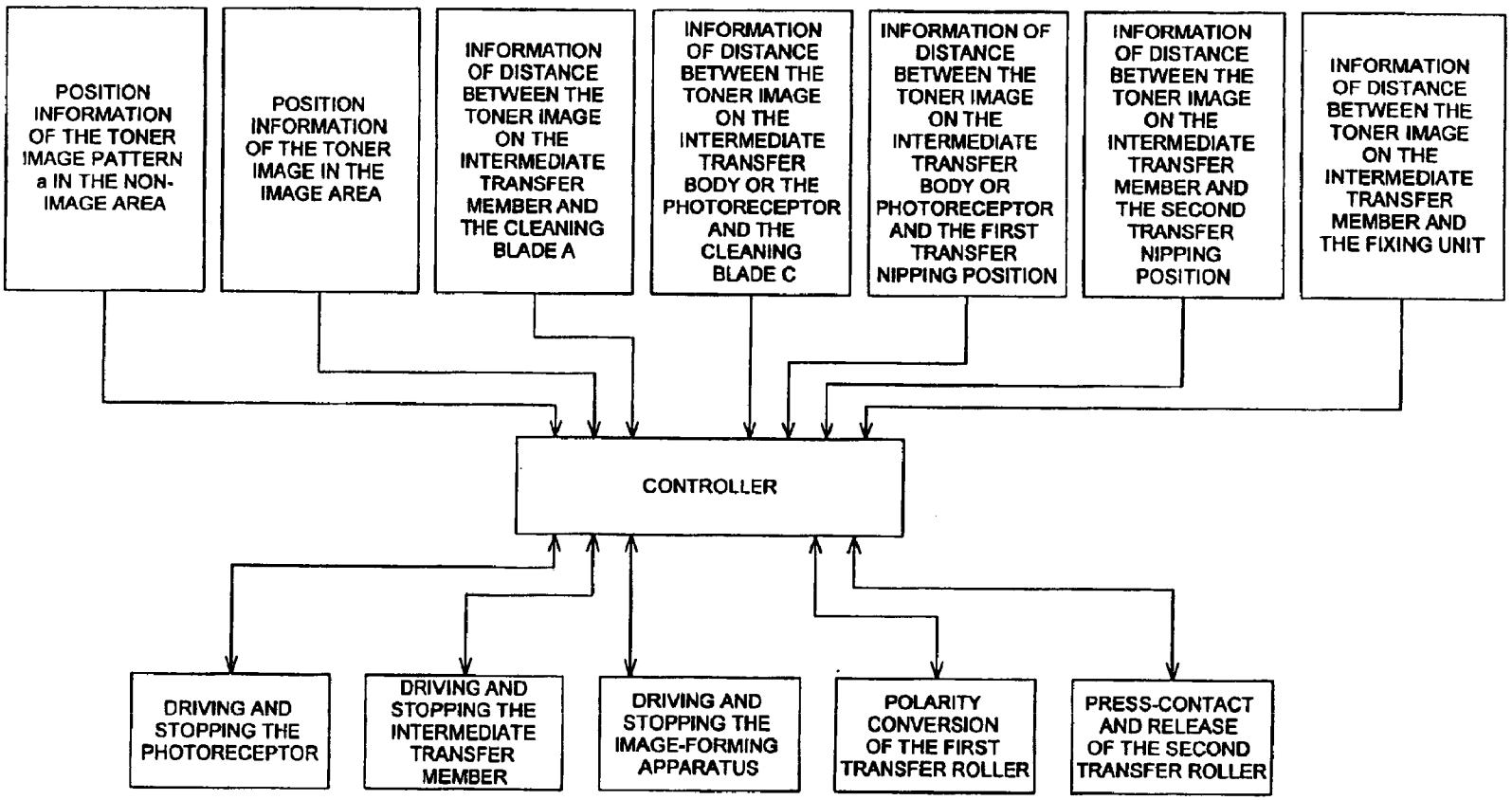
FIG. 2 is a conceptual diagram of controller used for an image-forming apparatus which is an embodiment of the present invention.

Further, in the above explanation, as shown in the conceptual diagram of controller in FIG. 2, controller imports various position and condition information so as to control each process as described in the embodiments.

When a toner image which has been formed when an image-forming apparatus stopped or when a jam occurred remains adhered to each member, such as a photoreceptor or an intermediate transfer member, or when the adhering toner remains contact-pressed by a first transfer member or a second transfer member, or when the adhering toner remains heated by a fixing member, the adherence between the toner and each member increases, causing blade cleaning to be impossible or a part of the toner component to remain adhered to the surface of the intermediate transfer member, which results in image problems which affect the creation of the next image. The present invention, which comprises controller for controlling to stop the photoreceptor and the intermediate transfer member (i.e. intermediate transfer belt) at a position located in the area which is not contaminated by the toner, eliminates such image problems.

What is claimed is:

1. An image forming apparatus for forming an image on a transfer material with toner, comprising:

a photoconductive member;

a developing unit for developing an electrostatic image on the photoconductive member by performing reversible deposition;

an intermediate transfer member facing the photoconductive member; and a controller to control a process of the image forming apparatus, wherein when the image forming apparatus stops, the controller stops the intermediate transfer member, after transferring a toner image pattern $\alpha$ formed on a non-image area of the photoconductive member to the intermediate transfer member, and after removing the toner image pattern $\alpha$ from the intermediate transfer member.

2. The image forming apparatus of claim 1, further comprising a first cleaning unit for removing toner remaining on the photoconductive member and a second cleaning unit for removing toner remaining on the intermediate transfer member.

3. The image forming apparatus of claim 1, wherein the non-image area follows the image forming area of the photoconductive member to the intermediate transfer member.

4. The image forming apparatus of claim 1, further comprising:

a first transfer section for transferring toner images from the photoconductive member to the intermediate transfer member; and a second transfer section for transferring toner images from the intermediate transfer member to the transfer material.

5. The image forming apparatus of claim 4, further comprising a first transfer roller at the first transfer section.

6. The image forming apparatus of claim 4, further comprising a second transfer roller at the second transfer section.

7. The image forming apparatus of claim 4, further comprising a fixing unit for fixing a toner image onto the transfer material.

8. The image forming apparatus of claim 2, wherein the first cleaning unit comprises a cleaning blade.

9. The image forming apparatus of claim 2, wherein the second cleaning unit comprises a cleaning blade.

10. The image forming apparatus of claim 1, wherein a developing bias superimposes a direct current voltage and an alternating current voltage.

11. The image forming apparatus of claim 1, wherein the toner is negatively charged.

12. An image forming apparatus for forming an image on a transfer material with toner, comprising:

a photoconductive member;

a developing unit for developing an electrostatic image on the photoconductive member by performing reversible deposition;

an intermediate transfer member provided to contact the photoconductive member;

a first transfer section for transferring a toner image from the photoconductive member to the intermediate transfer member; and a controller to control a process of the image forming apparatus, wherein when the image forming apparatus stops, the controller stops the photoconductive member after controlling at least one of a transfer voltage and a transfer current of the first transfer section so that a majority of toner in a toner image $\alpha$, which is formed on a non-image area of the photoconductive member, remains on the photoconductive member, and after removing the majority of toner in the toner image $\alpha$ remaining on the photoconductive member.

13. The image forming apparatus of claim 12, further comprising a first cleaning unit for removing toner remaining on the photoconductive member and a second cleaning unit for removing toner remaining on the intermediate transfer member.

14. The image forming apparatus of claim 12, further comprising a fixing unit for fixing a toner image onto the transfer material.

15. The image forming apparatus of claim 12, further comprising a second transfer section for transferring toner images from the intermediate transfer member to the transfer material.

16. The image forming apparatus of claim 13, wherein the first cleaning unit comprises a cleaning blade.

17. The image forming apparatus of claim 13, wherein the second cleaning unit comprises a cleaning blade.

18. The image forming apparatus of claim 12, further comprising a first transfer roller at the first transfer section.

19. The image forming apparatus of claim 15, further comprising a second transfer roller at the second transfer section.

20. The image forming apparatus of claim 12, wherein a developing bias superimposes a direct current voltage and alternating current voltage.

21. The image forming apparatus of claim 12, wherein the toner is negatively charged.

* * * * *